US005778456A

United States Patent [19]

Schimmel

[11] Patent Number: 5,778,456

[45] Date of Patent: Jul. 14, 1998

[54] REVERSIBLE BELT AND METHOD OF MANUFACTURE

[75] Inventor: Richard Schimmel, Massapequa Park, N.Y.

[73] Assignee: Blue Star Webbing Corp., Garden City Park, N.Y.

[21] Appl. No.: 714,227

[22] Filed: Sep. 16, 1996

[51] Int. Cl.[6] ..... A41F 3/02

[52] U.S. Cl. ..... 2/338; 2/312

[58] Field of Search ..... 2/338, 311, 312

[56] References Cited

U.S. PATENT DOCUMENTS

| | | | |
|---|---|---|---|
| 3,090,048 | 5/1963 | Loew | 2/338 |
| 3,530,031 | 9/1970 | Loew | 2/311 |
| 5,517,697 | 5/1996 | Boehm | 2/338 |

FOREIGN PATENT DOCUMENTS

| | | | |
|---|---|---|---|
| 944503 | 4/1974 | Canada | 2/338 |

*Primary Examiner*—Gloria Hale
*Attorney, Agent, or Firm*—Darby & Darby

[57] ABSTRACT

A reversible belt and method of manufacture in which an elongated strip of fabric is folded over and around a strip of filler material to form a belt section and two such sections are stacked in opposing relationship with a strip of a reinforcing material therebetween. The belt sections with the intermediate strip of material are joined together by a row of stitches along each edge of the belt with the stitches passing through the fabric of the sections and the reinforcing material.

12 Claims, 2 Drawing Sheets

REVERSIBLE BELT AND METHOD OF MANUFACTURE

FIELD OF INVENTION

The present invention relates to a reversible belt, or strap, and its method of manufacture.

BACKGROUND OF INVENTION

Various type of belts and straps are used for a variety of utilitarian and decorative purposes. For example, a belt or strap is used to bundle material, to hold clothing onto a person, to cinch a garment, such as a dress, etc. In many cases, in addition to serving the utilitarian function the belt is often made to have decorative characteristics. Various types of belts are available and they are made of many type of materials, such as fabric, leather, etc.

Where belts are made of fabric it is sometimes desirable to make them reversible so that if one side wears or is permanently stained, the belt can be reversed to show the side without the wear or stain. When the belt also is to have decorative aspects, making the belt reversible permits two types of decorative effects, one on each side of the belt.

It is preferred that the manufacture of such reversible fabric belts be carried out in a manner that is economical and efficient.

OBJECTS OF THE INVENTION

It is therefore an object of the present invention to provide a reversible belt and its method of manufacture.

A further object is to provide a reversible fabric belt made of two sections joined together and a method of manufacture.

An additional object is to provide a reversible belt of a predetermined thickness made by joining together two sections each formed by a fabric strip folded over and around a strip of filler material which are joined together with an intermediate strip of reinforcing material.

SUMMARY OF THE INVENTION

The present invention is directed to a reversible fabric belt and its method of manufacture. In accordance with the invention the belt is made of two similar sections. Each of the belt sections is formed by a strip of the fabric that is folded over and around a strip of filler material without being sealed or attached to the filler and, preferably, without the opposing edges of the fabric overlapping after being folded over the filler strip. The two belt sections are arranged with the faces having the edges of the folded fabric facing each other and a strip of reinforcing material is placed therebetween. The sections of the belt are then sewn through along the edges of the fabric and reinforcing material. The resulting belt has the thickness of the two sections, each with its fabric and filler strip, and the intermediate reinforcing strip between the two belt sections. The fabric strip of each belt section can be of the same or different material to produce desired strength and/or decorative characteristics.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
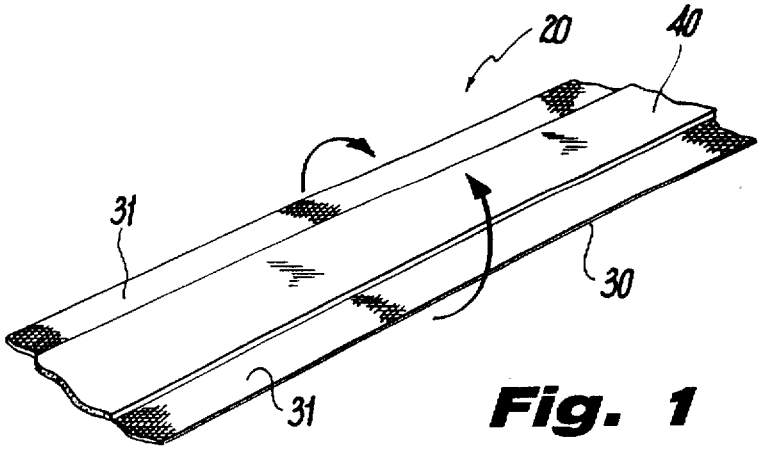
FIG. 1 is a perspective view of one of the belt sections.
Figure 2A:
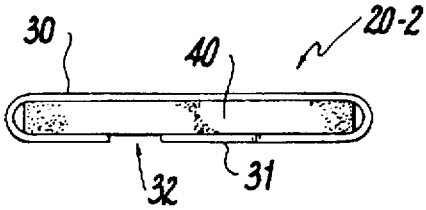
FIGS. 2(*a*)–2(*d*) are end elevational views of the reversible belt showing the various steps in its manufacture.
Figure 2B:
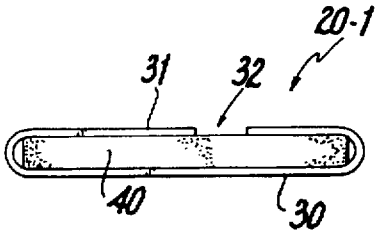
Figure 2C:
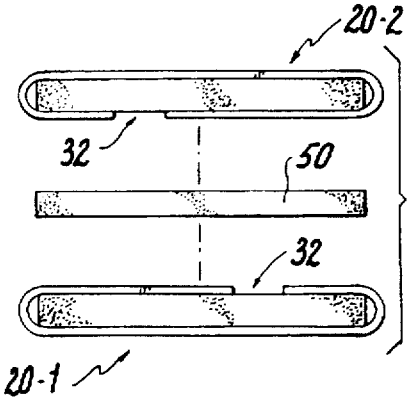
Figure 2D:
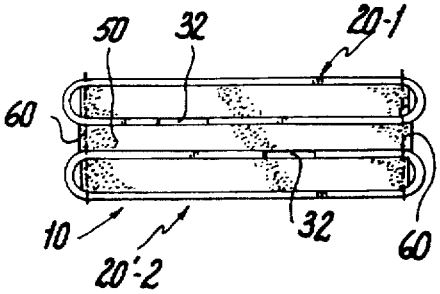
Figure 3:
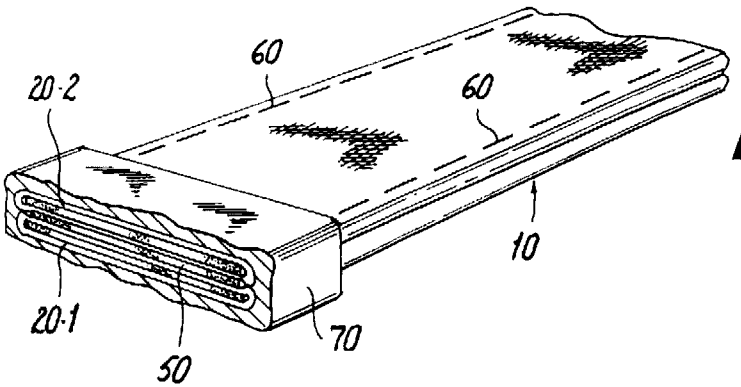
FIG. 3 is a perspective view of a portion of a finished reversible belt in accordance with the invention.

Referring to FIGS. 1–3, according to a preferred embodiment, the invention, a reversible belt 10, has two sections 20-1 and 20-2. Each of the sections 20-1 and 20-2 is formed in a similar manner. First, a strip of fabric 30 of the desired length and width is provided. The fabric can be of any desired type. One type found suitable is a 100% polyester fabric that can be of any desired weight (thickness), weave and color, including decorative colors and patterns.

A strip 40 of a filler material is placed on the strip of fabric 30 leaving an overhanging part 31 of fabric on each edge of the filler material strip. The filler material strip 40 is to give body to the belt section 20 and can be, for example, of a fibrous polyester material, such as a non-woven polyester material.

As seen in FIGS. 2(*a*) and 2(*b*), in making a belt section 20, the overhanging part 31 of the fabric strip 30 on each side of the strip of filler material 40 is folded over and around the elongated corresponding edges of the filler material strip. This is shown by the arrows of FIG. 1 and the completed folded sections 20-1 and 20-2 of FIGS. 2(*b*) and 2(*a*). The folding of the fabric overhang part 31 can be accomplished by hand, by folding leaves or by other suitable means. It is preferred that the edges of the fabric overhang parts 31 do not overlap when they are folded so that a small gap 32 is left between the opposing edges of the fabric folded over the filler material strip. If desired, the edges of the overhanging part 31 can be left to overlap after being folded over the filler material strip 40. In some cases this is done when it is desired to increase the thickness of the finished belt.

At least two of the belt sections 20-1 and 20-2 are needed to form the reversible belt 10 of the invention. The fabric of each of the two sections 20 can be of the same material or of different materials. That is, the fabric 30 of each of the two sections can be of different type, thickness, color, etc. It is preferred that the fabric strip of each of the sections be oriented to optimize the desired strength and/or decorative pattern of the belt. For example, if the fabric has a bias to its weave, the line of the bias can be at an angle to the longitudinal axis of the fabric strip and the direction of the bias line of the two strips reversed. This would achieve maximum strength for the belt in its longitudinal direction.

As seen in FIGS. 2(*a*) and 2(*b*), the two belt sections 20-1 and 20-2 are placed with the edges of the folded fabric overhanging parts 31, and gaps 32 where used, facing each other. When the sections have the gaps 32 between the edges of the folded fabric strip, it is preferred that the gaps be offset from each other, as shown in FIGS. 2(*a*) and 2(*b*) so that the finished belt will have a more uniform thickness across its width. The same is true if the edges of the overhang parts overlap.

In FIG. 2(*c*) it is seen that a strip of reinforcing material 50 is placed between the two opposing belt strip sections 20-1 and 20-2. The reinforcing material strip 50 provides a degree of stiffness to the finished belt and can be made, for example, of PERMAFUZE. This material is a composite of cotton and polypropylene. Other suitable materials can be used.

As seen in FIGS. 2(*d*) and 3, the two belt strip sections 20-1 and 20-2 are brought together and sewn along the side edges of the fabric 30 by any conventional sewing technique with stitches 60. The stitches 60 pass through the fabric and through the reinforcing strip 50.

The completed reversible belt is shown in FIG. 3. The two sections 20-1 and 20-2 are shown as is the reinforcing strip 50 and the stitches 60. A part of a metal ferrule 70 that can be placed on the end of the finished belt is shown partly broken away. A buckle, not shown, can be on the other end of he belt. As seen, the completed reversible belt has considerable strength in the longitudinal direction since it effectively formed by four layers of the fabric. The belt is reversible since the outer layer of fabric of each of the sections 20-1 and 20-2 can be the same or have a desired different color or pattern. To increase the thickness of the belt, additional sections 20 can be used. For example, there can be three sections 20 stacked one upon the other. Also, a strip of the reinforcing material 50 can be placed between each pair of belt sections.

The reversible belt can be made on sequential basis one at a time by making individual sections 20 of the desired length and joining two of the sections together with the intermediate reinforcing material strip 50. A belt section 20 also can be made on a continuous basis and a system for accomplishing this is illustratively shown in FIG. 4 in schematic form.

Figure 4:
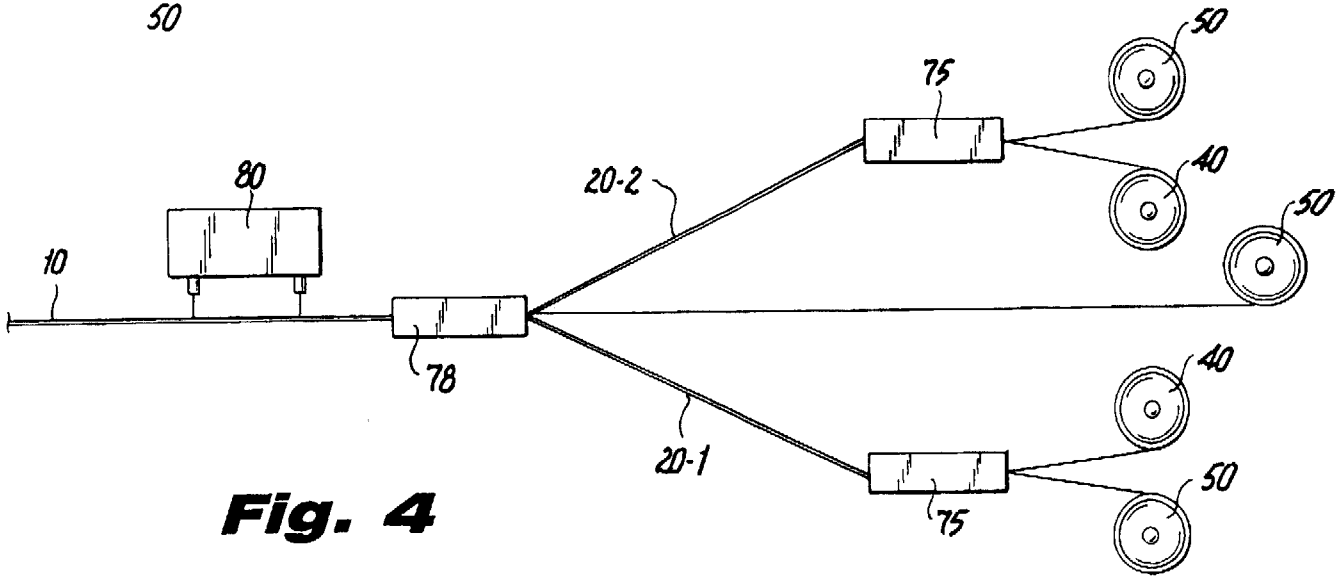
FIG. 4 is a schematic diagram of a system for making the reversible belt on a continuous basis.

As seen in FIG. 4, there are two sets of rolls of each of the fabric strip material 30 and the filler strip material 40. The two strips of material 30 and 40 of each set of rolls of the material are fed on a continuous basis through a respective chute 75 that folds the overhanging parts 31 of the fabric strip 30 over the filler material strip 40 to form the respective belt sections 20-1 and 20-2. A roll of the reinforcing strip material 50 is fed between the two belt sections 20-1 and 20-2. The assembly of the two sections 20-1 and 20-2 and intermediate strip of reinforcing material 50 is passed through a collar 78 that presses the components together. A dual needle or dual head sewing machine 80 is located at he outlet end of the collar 78 and makes the stitches 60 on each side of the reinforcing strip 50. The continuous reversible belt leaving the sewing machine is cut to the desired lengths and a ferrule and buckle applied as desired.

I claim:

1. A reversible belt comprising:

first and second belt sections stacked one above the other in opposing relationship, each belt section formed by an elongated flat strip of fabric having parts folded over and around the corresponding edges of an elongated flat filler material strip;

an elongated strip of reinforcing material between said two opposing belt sections; and a row of stitches along the length of each edge and extending through said two opposing belt sections with the strip of reinforcing material therebetween joining said belt sections.

2. A reversible belt as in claim 1 wherein said fabric of at least one of said belt sections is polyester.

3. A reversible belt as in claim 2 wherein said strip of reinforcing material is of cotton and polypropylene.

4. A reversible belt as in claim 1 wherein the width of a said filler material strip is less than the width of its corresponding said belt section and each said row of stitches passes only through the fabric material of each edge of a said belt section and said strip of reinforcing material.

5. A reversible belt as in claim 1 wherein said fabric strip is folded over a corresponding filler material strip leaving a gap between the opposing edges of the folded over parts of the strip of fabric and the two belt sections are stacked with the gap of each section in opposing relationship and offset from each other.

6. A reversible belt as in claim 5 wherein the width of a said filler material strip is less than the width of its corresponding said belt section and each said row of stitches passes only through the fabric material of each edge of a said belt section and said strip of reinforcing material.

7. A reversible belt as in claim 5 wherein said fabric of at least one of said belt sections is polyester.

8. A reversible belt as in claim 7 wherein said fabric for each belt section is the same.

9. A reversible belt as in claim 7 wherein said strip of reinforcing material is of cotton and polypropylene.

10. A method of making a reversible belt comprising the steps of:

feeding together (a) a first set of elongated flat strips of each of a fabric and of a filler material with the strip of fabric being wider than the strip of filler material;

(b) a second set of elongated flat strips of each of a fabric and of a filler material with the strip of fabric being wider than the strip of filler material; and (c) an elongated flat strip of a reinforcing material between said first and second sets of strips;

folding overhanging parts of each said strip of fabric over and around the edges of the corresponding filler material strip to form opposing belt sections with said strip of reinforcing material therebetween; and stitching said two belt sections together with a row of stitches along the length of each of the edges of said belt sections with the strip of reinforcing material therebetween.

11. A method as in claim 10 wherein the width of said filler material strip is less than the width of each said belt section and said step of stitching makes each said row of stitches to pass only through the fabric material of each said belt section and said strip of reinforcing material.

12. A method as in claim 11 wherein said folding step folds the fabric strip over a corresponding filler material strip leaving a gap between the opposing edges of the folded over parts of the strip of fabric and further comprising the step of stacking the two belt sections with the gap of each said section in opposing relationship and offset from each other.

* * * * *